US008040364B2

(12) United States Patent
Stowe et al.

(10) Patent No.: US 8,040,364 B2
(45) Date of Patent: Oct. 18, 2011

(54) LATENT RESISTIVE IMAGE LAYER FOR HIGH SPEED THERMAL PRINTING APPLICATIONS

(75) Inventors: Timothy D. Stowe, Alameda, CA (US); Eugene M. Chow, Freemont, CA (US); Ashish V. Pattekar, San Mateo, CA (US); Eric Peeters, Mountain View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 148 days.

(21) Appl. No.: 12/502,949

(22) Filed: Jul. 14, 2009

(65) Prior Publication Data

US 2011/0012980 A1 Jan. 20, 2011

(51) Int. Cl.
*B41J 2/385* (2006.01)

(52) U.S. Cl. ..... 347/110; 347/111

(58) Field of Classification Search ..... 347/171, 347/110, 111

See application file for complete search history.

(56) References Cited

U.S. PATENT DOCUMENTS

| | | | |
|---|---|---|---|
| 2,800,699 | A | 8/1955 | Armstrong |
| 3,655,379 | A | 4/1972 | Gundlach |
| 3,741,118 | A | 6/1973 | Carley |
| 3,798,365 | A | 3/1974 | Browning et al. |
| 3,986,874 | A | 10/1976 | Marsh |
| 4,080,897 | A | 3/1978 | Gundlach |
| 4,400,412 | A | 8/1983 | Scanlon et al. |
| 4,462,035 | A | 7/1984 | Koto |
| 4,838,940 | A | 6/1989 | Kan et al. |
| 4,945,833 | A | 8/1990 | Arahara et al. |
| 4,962,389 | A | 10/1990 | Kan et al. |
| 4,972,200 | A | 11/1990 | Arahara et al. |
| 5,017,223 | A | 5/1991 | Kobayashi et al. |
| 5,019,835 | A | 5/1991 | Arahara et al. |
| 5,032,849 | A | 7/1991 | Arahara et al. |
| 5,041,843 | A | 8/1991 | Tohyama et al. |
| 5,084,716 | A | 1/1992 | Koumura et al. |
| 5,100,468 | A | 3/1992 | Yuasa et al. |
| 5,132,706 | A | 7/1992 | Yuasa et al. |
| 5,142,306 | A | 8/1992 | Arahara et al. |
| 5,143,546 | A | 9/1992 | Yuasa et al. |
| 5,151,712 | A | 9/1992 | Arahara et al. |
| 5,175,568 | A | 12/1992 | Oyamaguchi et al. |
| 5,177,506 | A | 1/1993 | Katano |

(Continued)

FOREIGN PATENT DOCUMENTS

| | | |
|---|---|---|
| CA | 2404328 | 9/2002 |

(Continued)

OTHER PUBLICATIONS

Machine-generated translation of JP 2002-109797, published on Apr. 2002.*

(Continued)

*Primary Examiner* — Huan Tran
(74) *Attorney, Agent, or Firm* — Marger Johnson & McCollom, P.C.

(57) ABSTRACT

An imaging system including an image receiving structure including a tunable-resistivity material; and an energy source to emit an energy beam at the image receiving structure to pattern-wise program the tunable-resistivity material. A resistivity can be pattern-wise changed. Marking material can be pattern-wise adhered in response to the pattern-wise changed resistivity.

19 Claims, 7 Drawing Sheets

U.S. PATENT DOCUMENTS

| | | | | |
|---|---|---|---|---|
| 5,227,265 | A | 7/1993 | DeBoer et al. | |
| 5,249,000 | A | 9/1993 | Okabe et al. | |
| 5,262,374 | A | 11/1993 | Okabe et al. | |
| 5,436,642 | A | 7/1995 | Oyamaguchi et al. | |
| 5,471,234 | A | 11/1995 | Katano et al. | |
| 5,666,598 | A | 9/1997 | Sugita et al. | |
| 5,942,094 | A | 8/1999 | Castegnier et al. | |
| 6,045,674 | A | 4/2000 | Castegnier | |
| 6,056,388 | A | 5/2000 | Maximovsky et al. | |
| 6,090,257 | A | 7/2000 | Castegnier et al. | |
| 6,108,021 | A | 8/2000 | Morikawa et al. | |
| 6,161,928 | A | 12/2000 | Morikawa et al. | |
| 6,270,194 | B1 | 8/2001 | Maximovsky et al. | |
| 6,330,857 | B1 | 12/2001 | Maximovsky et al. | |
| 6,356,289 | B1 | 3/2002 | Tomita et al. | |
| 6,387,588 | B1 | 5/2002 | Katano et al. | |
| 6,396,528 | B1 | 5/2002 | Yanagawa | |
| 6,725,777 | B2 | 4/2004 | Katano | |
| 2003/0156178 | A1 | 8/2003 | Lehmann | |
| 2005/0212888 | A1 | 9/2005 | Lehman et al. | |
| 2007/0273941 | A1 | 11/2007 | Ito | |
| 2007/0274193 | A1 * | 11/2007 | Akiyama et al. | 369/126 |

FOREIGN PATENT DOCUMENTS

| | | | |
|---|---|---|---|
| DE | 10106415 | A1 | 9/2002 |
| EP | 0292938 | | 11/1988 |
| EP | 0322903 | | 7/1989 |
| GB | 2194756 | | 3/1988 |
| JP | 2002-109797 | * | 4/2002 |
| WO | WO0172518 | | 4/2001 |

OTHER PUBLICATIONS

S. L. Gaudioso, J. H. Becker, and D. S. Sypula, "Mechanisms of Ink Release in Waterless Lithography," TAGA Proceedings, Taga Office, 1975. p. 177-194.

O. Homburg, D. Hauschild, F Kubacki, V. Lissotschenko, "Efficient beam shaping for high-power laser applications" Laser Source and System Technology for Defense and Security II, SP Proceedings of SPIE—vol. 6216, May 2006.

Bird, Stewart and Lightfoot, "Transport Phenomena, 2nd Edition", Chapter 1.5 the Molecular Theory of the Viscosity of Liquids, John Wiley & Son, New York, pp. 29-31.

Vad. I. Surikov et. al. "Specific heat and magnetic susceptibility of vanadium dioxide." Sov. Phys. Solid State 29(2), 1987, p. 351.

I.R. McNab and William R. Gass. "High-Current Density Carbon Fiber Brush Experiments in Humidified Air and Helium" IEEE Transactions on Components, Hybrids, and Manufacturing Technology, vol. CHMT-3, No. 1, Mar. 1980, pp. 26-30.

Philip Reichner. "Metallic Brushes for Extreme High-Current Applications," IEEE Transactions on Components, Hybrids, and Manufacturing Technology, vol. CHMT-3, No. 1, Mar. 1980, pp. 21-26.

F. C. Case, "Improved Vo2 thin Films for Infrared Switching," Applied Optics vol. 30, No. 28, pp. 4119-4123 (1991).

Braudy, "Laser Writing," Proceedings of the IEEE, pp. 1771-1772 (1969) (RCA Labs).

D. Young et al. "Plume and Jetting Regimes in a Laser Based Forward Transfer Process as Observed by Time-Resolved Optical Microscopy" Mat. Res. Soc. Symp. Proc. vol. 698 (2002).

"Photoinduced Reversible Change on Wettability on PhotoChromic Polymer Surface," Japanese J. of Polymer Science and Technology, vol. 37, No. 4 (1980) pp. 287-291.

"Studying the Possibility of Aplying the Light-Hydraulic Effect to Digital Printing" L.K Vodop yanov. P.S. Kozlov, I.V. Kucherenko, S.N. Maksimovskii, G.A. Radutskii, Instruments and Experimental Techniques, vol. 46, pp. 549-553.

European Patent Office Search Report dated Mar. 4, 2010, The Hague, Netherlands.

* cited by examiner

LATENT RESISTIVE IMAGE LAYER FOR HIGH SPEED THERMAL PRINTING APPLICATIONS

BACKGROUND

This disclosure relates to imaging systems and, in particular, to imaging systems for transferring marking material using a latent resistive layer.

Printing technologies fall into two distinct groups: those that are digital and allow every printed page to contain variable text and images and those that are master plate based and allow high volume duplication of a single image. Common examples of digital printing technologies include inkjet, electrophotography (EP), and thermal transfer. Common examples of master based duplications technologies include offset lithography, flexography, and gravure.

Unfortunately, all of the digital printing technologies are severely limited in speed as compared to the master based duplication processes. This speed limitation reduces their productivity and fundamentally limits their economics to copy run lengths no larger than a few hundred copies. In the case of inkjet printing, the marking inks consist of very dilute pigments or dyes in a solvent carrier and print speed is limited by the energy require for solvent evaporation. In the case of electro-photography, print speed is limited by the energy required for toner fusion. Finally, the print speed for thermal transfer is limited by the energy that is required to transform inked material on a ribbon from either a solid into a liquid or for the case of dye diffusion thermal transfer (D2T2), the energy from a solid to a gas. A large amount of energy is required for these thermal methods because the ink must be raised above a phase change temperature and the latent heat of melting or evaporation must be delivered. In addition to these considerations, the lower pigment concentration of typical digital marking materials can lead to higher marking pile height or image bleed. This is undesirable in terms of gloss uniformity, tactile feel, stacking thickness for books, and fold fastness. Furthermore, each of the digital marking materials usually has a much stricter limitation on color gamut and substrate latitude and size when compared with offset lithography.

In waterless offset technologies, a patterned polydimethylsiloxane (PDMS) layer, commonly referred to as silicone, is used to block the transfer of ink. That is, silicone is used to prevent the transfer of the ink. Under the rapid shearing forces of the NIP, the viscoelastic cohesive forces within the ink can exceed the surface adhesion force at the silicone interface and the ink is rejected from the non-image areas of the cylinder. In non-silicone regions the adhesive forces overcome the built-in cohesive forces of the ink and the ink film splits apart thus leaving behind a layer of ink in the imaging areas.

In most offset printing systems, the mass ratio of ink film splitting in these imaging areas such as between the imaging plate and the offset blanket is usually a faction between 30/70 and 50/50. In practical terms, this means that roughly 10 blank pages are needed to remove enough ink so that the previous image is no longer visible. This is not a problem when running long jobs because much of the make ready paper is used to tune the color and alignment of colors on a page so no additional cost is of concern. This is an issue when variable data is introduced because ghosting can result from the remaining ink from a prior image.

There have only been a few attempts at high quality high speed variable data digital printing with higher pigment concentration inks. Gravure and flexography inks with viscosities in the range of 50-1000 cp have been shown to respond to electrostatic pulling over short distances. However, the electrostatic forces are too weak to work with high viscosity high pigment concentration offset inks with viscosities above 100,000 cps.

Currently, these issues make it incredibly challenging to print highly viscoelastic marking materials such as offset or waterless offset inks (i.e. marking materials having dynamic viscosities of 10,000-1,000,000 cps) in a digital fashion with variable data on each and every page.

DETAILED DESCRIPTION OF THE EMBODIMENTS

Figure 1:
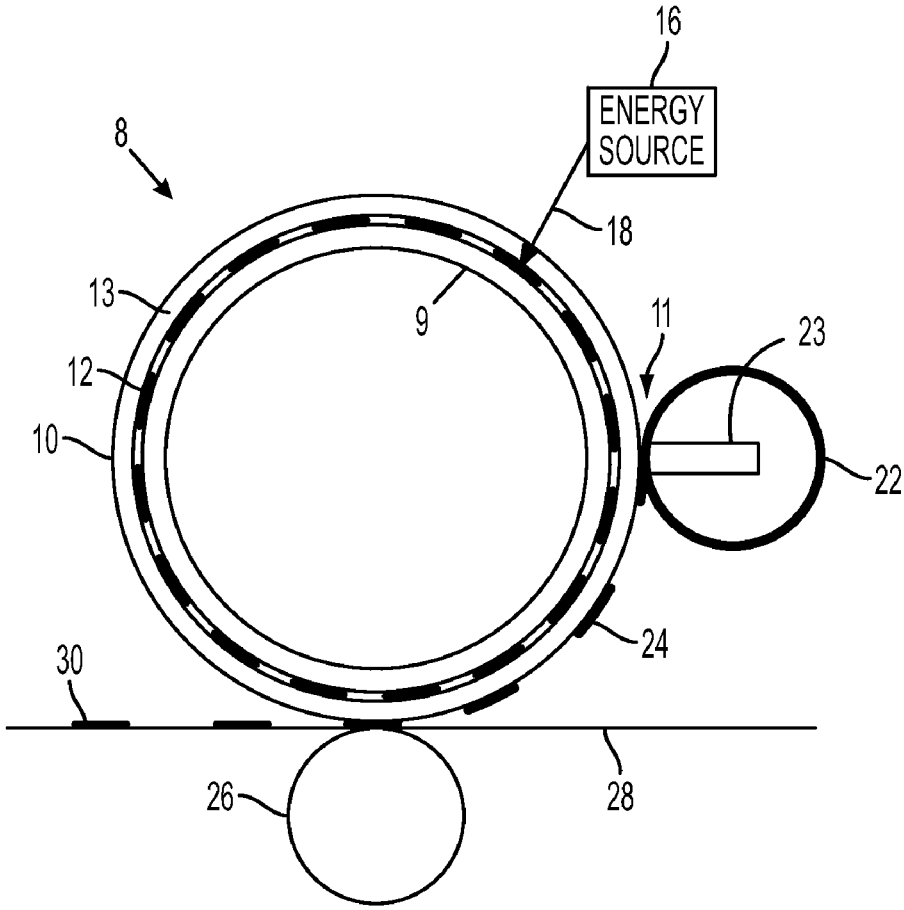
FIG. 1 is a diagram illustrating an imaging system having a tunable-resistivity material according to an embodiment.

Embodiments will be described with reference to the drawings. Embodiments allow the formation of a pattern-wise image by selective heating of marking material in the nip between the donor and image receiving structures.

A siloxane, such as silicone, also referred to as polydimethylsiloxane (PDMS), normally repels viscoelastic marking materials. Viscoelastic marking materials include waterless offset inks that are currently used in short run offset presses such as the Heidelberger Quickmaster or the KBA Metro. Viscoelastic marking materials are different from most marking materials in that they have a complex elastic modulus where both elasticity and viscosity (i.e. G' and G") both play a substantial roll in determining the marking material rheology.

The internal cohesive energy of these marking materials can be made much larger than the adhesion energy to the surface of silicone. As a result, the marking materials can be removed off of a silicone surface with near 100% efficiency. However, by heating such marking materials, their viscosity and internal cohesive forces (or tack) can temporarily be lowered enough to allow them to pattern-wise adhere to a silicone surface. Once on the silicone, such images can be transferred with near 100% efficiency to almost any substrate as long as the substrate has higher adhesion strength than the silicone. As a result, a non-ghosting variable data offset transfer process can be realized using waterless offset inks or other viscoelastic marking materials.

While waterless offset inks generally do not stick to silicone, if these inks are heated above their intended temperature range for use, these inks will readily stick to a silicone layer. In some cases as little as about 40 degree temperature rise allows the waterless ink to go from a condition of 0% transfer coverage on to silicone to a full solid coverage transfer to a silicone surface. One of the reasons that waterless offset systems must control the temperature to within a few degrees is to overcome such effects which can sometimes lead to the over toning of plates due to friction associated heating. Although this effect is undesirable in some applications, it can be used advantageously to transfer marking materials in a digital fashion. Moreover, the energy needed to change a marking material by as little as about 40 degrees can be less than the energy needed to induce a phase change in the marking material.

In an embodiment, a latent electrical resistive layer can be formed in an image receiving structure. This electrically resistive layer can be optically or electrically heated and transformed from a high impedance or low impedance electrical state. One class of such materials known as phase change materials usually consist of many different binary, tertiary, or quaternary chalcogenide alloys such as Ge2Sb2Te5 having low melting points and high crystallization speeds. Such alloys can be used in DVD and R/W CD ROMS. Because the thickness of such layers are only a few hundred angstroms, they can be repeatedly switched between amorphous and crystalline states with low power semiconductor lasers in the range of only 1-10 mW; In comparison, this is much less power than is needed to directly heat marking materials in thermal transfer printing technologies. Once a latent resistive image has been formed, a constant electrical voltage can be applied across the resistive layer to deliver an image wise thermal pattern that is no longer limited by row-to-row line based heating and without the need of high speed high current electronic drivers.

An embodiment can be applicable to various novel printing concepts that use printing of high viscosity marking materials such as variable fountain solution patterning of offset inks, variable thermal tack transfer printing of waterless offset inks, pattern-wise tacking of toner, and variable thermal shooting of front loaded inks, or more rapid printing using existing thermal transfer technologies.

FIG. 1 is a diagram illustrating an imaging system 8 having a tunable-resistivity material according to an embodiment. In this embodiment, an image receiving structure 10 includes a tunable-resistivity material 12. An energy source 16 is configured to emit an energy beam 18 at the image receiving structure 10 to pattern-wise program the tunable-resistivity material 12. A power supply 23 is configured to provide current to the tunable-resistivity material 12.

In an embodiment, the imaging system 8 includes a donor structure 22, an image receiving structure 10 to receive marking material in an image-wise manner, and an energy source 16. The image receiving structure 10 is defined as the structure having a surface onto which an image of a layer of marking material is first formed and then transferred to a substrate 28. The image receiving structure 10 can include materials forming the tunable-resistivity material 12 deposited over a supporting substrate 9. In the embodiment shown in FIG. 1 this supporting substrate 9 includes a transparent hollow drum.

The image receiving structure 10 can be a multi-layer surface. The image receiving structure 10 can include an outer marking material receiving layer 13. The outer layer 13 is made from a material which selectively allows the marking material to stick to it when the marking material is sufficiently changed in viscosity or tack due to an image wise change in temperature. As discussed earlier, in an embodiment, this outer layer 13 could be made from a siloxane such as silicone which can selectively allow transfer onto this layer if waterless offset inks are heated. In another embodiment, the outer layer 13 can be formed of Poly(Nisopropylacrylamide), side chain liquid crystal polymers, or other materials which can change their surface adhesion and dynamic wetting properties with the application of energy.

In an embodiment, the outer layer 13 is disposed over the tunable-resistivity material 12. However, the functional material making up the tunable-resistivity material 12 could also be incorporated into the outer layer 13. For example, the tunable-resistivity material 12 can be formed by a dispersion of nanoparticle material in the outer layer 13 if the nanoparticle material does not greatly change the surface wetting properties of the outside surface of the outer layer 13. Under this arrangement the tunable-resistivity material 12 and image receiving structure 10 can be realized in one layer of coated material.

The donor structure 22 is configured to receive a substantially uniform layer of marking material. Forming rollers, anilox rollers, doctor blades, or the like can all be used to form the marking material on the donor structure 22. In this embodiment, a substantially uniform layer of marking material is desired. Thus, any forming, conditioning, or the like to create such a layer of marking material can be used. As a result, when the marking material enters a nip 11 as the donor structure 22 moves, a substantially uniform layer of marking material enters the nip 11.

As described above, viscoelastic waterless offset inks can be used as marking materials. However, a marking material is not limited to inks. Marking materials can be any material that has variable internal cohesive characteristics. In particular, any material that has internal cohesive characteristics that decrease when an amount of heat is applied can be used as a marking material. For example, marking materials can include highly viscoelastic gel materials, viscoelastic wax based materials, low melt toners, hot melts such as those used for laminating or gluing boxes along a seam, or any other highly non-linear viscoelastic marking materials. In particular, the variable data patterning of hot melt glue seams is an interesting application that may allow for much higher through put than a vector scanning glue nozzle based system.

The power supply 23 can be any variety of circuitry that can supply current to the tunable-resistivity material. For example, the power supply can be an alternating current (AC) power supply, a direct current (DC) power supply, a switched power supply, a linear power supply, or a combination of such power supplies. The power supply 23 can, but need not supply power to all of the tunable-resistivity material. As will be described in further detail below, the power supply can be configured to supply current only to less than all of the tunable-resistivity material at any one time.

In an embodiment, the power supply 23 can be configured to supply power to the tunable-resistivity material through an electrical inductive technique. For example, a high frequency induction coil, a series of coils, or the like can be used to induce a current in the tunable-resistivity material. The power supply 23 can be formed from such coils disposed to induce current in the tunable-resistivity material 12.

As used in this disclosure, an energy source 16 is any device, apparatus, system, or the like that can emit thermal energy, microwave energy, optical energy, or the like. For example, the energy source 16 can include heating elements, masers, lasers, or the like. In another embodiment, a raster optical scanning (ROS) systems with multiple rows of independently addressed semiconductor lasers can be used as an energy source to increase the data ripping speed. In an embodiment, the energy source 16 can be a high power LED array situated outside the image receiving structure 10. In another embodiment, the energy source 16 can be a raster scanned high power diode laser.

Although the energy source 16 is illustrated as outside of the image receiving structure 10, the energy source 16 can be disposed wherever it can pattern-wise tune the tunable-resistivity material 12. For example, the energy source 16 can be disposed within the image receiving structure 10. Accordingly, the energy beam 18 can pass through the substrate 9 of the image receiving structure 10 to tune the tunable-resistivity material 12.

To pattern-wise tune the tunable-resistivity material 12, the energy source 16 can be pattern-wise modulated. The pattern-wise modulation can be any kind of modulation. Amplitude modulation, frequency modulation, on-off modulation, direct modulation, external modulation, or the like can be used. For example, one or more lasers such as fiber lasers, semiconductor lasers, or the like can be scanned across the across the tunable-resistivity material 12 to transform portions into different resistivity states. The intensity, duty cycle, or the like of the energy source 16 can be modulated to obtain such different resistivity states. As a result, the tunable-resistivity material 12 can be tuned between a low resistivity state and a high resistivity state.

Using the tuned material 12, marking material can be selectively transferred to the image receiving structure 10 based upon imaging wise heating. As described above, the energy source 16 is used to pattern-wise tune the resistance of the tunable-resistivity material 12. The marking material can be provided on a donor structure 22. The power supply 23 supplies energy to the tuned material 12. Such energy can be applied when the image receiving structure 10 with the tuned material 12 is in contact with the marking material on the donor structure 22. Since the resistivity is pattern-wise tuned, the image receiving structure 10 can be pattern-wise heated. As described above, the adhesion of the marking material to the image receiving structure can be related to the temperature of the marking material. By pattern-wise heating the image receiving structure 10, marking material is pattern-wise heated. Accordingly, marking material is pattern-wise transferred as the image receiving structure 10 separates from the marking material on the donor structure 22. Accordingly, patterned marking material 24 remains on the image receiving structure 10.

A substrate 28 can be brought in contact with the image receiving structure 10. For example, an impression roller 26 can contact the substrate 28 to the image receiving structure 10. As the patterned marking material 24 is moved to contact the substrate 28, the patterned marking material 24 can cool, increasing its internal cohesiveness. As a result, its adhesion to the image receiving structure 10, in particular to a surface of the outer layer 13, is reduced. Patterned marking material 30 is then transferred to the substrate.

As described above, a silicone surface is normally used to repel marking materials. By pattern-wise increasing the adhesion to transfer the marking materials to the image receiving structure 10, then cooling the marking materials to reduce the adhesion, an efficient transfer of marking materials to the substrate 28 approaching 100% can be achieved. Although the patterned marking materials 24 have been described as being cooled prior to being transferred to the substrate 28, as long as the adhesion of the patterned marking materials 24 to the substrate 28, even in their lower internal cohesion state, is greater than the adhesion to the image receiving structure 10, the pattern marking materials 24 can be efficiently transferred. In an embodiment, electronic and lithographic patterning of the image receiving structure 10 is not required.

In an embodiment, the marking material did not undergo a phase transition from a solid to a liquid state. In contrast, the marking material remained in a viscoelastic state even though the applied heat lowered the viscosity of the marking material by increasing its temperature. That is, an amount of energy was transferred to the marking material sufficient to change its viscosity, but insufficient to change its phase. This does not mean that the energy transferred must be limited to less than that which would induce a phase change. In contrast, the tunable-resistivity material 12 can be similarly used to pattern-wise heat the marking material to induce a phase change.

As described above, the adhesion of the marking material to the image receiving structure 10 is changed. In addition, the internal cohesiveness of the marking material can be changed. That is, by heating the marking material, the internal cohesiveness decreases relative to the adhesion of the marking material to the image receiving surface 10. As a result, when the marking material exits from the nip 11, marking material can adhere to the image receiving surface as the internal cohesion is overcome.

In an embodiment, the adhesion of the marking material to the image receiving surface can be affected by a change in the affinity of the outer layer 13 of the image receiving surface. For example, as the outer layer 13 is heated, the oleophillic, hydrophilic, or other similar nature can change in response to heat. Accordingly, a change in the adhesion of the marking material to the image receiving surface 10 whether due to changes in the marking material of the image receiving surface 10, a change in the internal cohesiveness of the marking material, a combination of such changes, or the like can be used to facilitate the transfer of marking material to the image receiving surface 10.

In an embodiment, the power supply 23 can apply a voltage to the tunable-resistivity material 12 to pattern wise heat the material. For example, assume that there is a 1:100 ratio of resistances of tuned states of the tunable-resistivity material 12. Accordingly, when the same voltage is applied, there will be a 100:1 ratio of power dissipated in the tunable-resistivity material 12.

In an embodiment, once the energy source 16 has finished forming tuning the resistivity of the tunable-resistivity material 12 on the image receiving structure 10, selective electrical heating can be accomplished near the nip 11 using the power supply 23. As will be described in further detail below, the voltage drop due to electrical resistance along the electrodes coupled to the tunable-resistivity material 12 can be lower than the voltage drop across the tunable-resistivity material 12 regardless of its state. Accordingly, more energy can be directed towards the pattern-wise programmed material to concentrate the heat in the programmed regions.

As described above, the image receiving structure 10 is pattern-wise heated. The image receiving structure with the pattern-wise tuned material 12 can be brought in contact with marking material on the donor structure 22 in the nip 11. As a result, the marking material is pattern wise separated from the donor structure 22.

In embodiment, a second energy source (not illustrated) can be used to change the tunable-resistivity material 12 into particular resistance state. That is, at a point after the patterned marking material 24 has been transferred to the image receiving structure 10, the second energy source can tune the resistivity of the tunable-resistivity material 12 to substantially the same state. For example, after the patterned marking material 24 has been transferred to the substrate 28, the tunable-resistivity material 12 can be tuned to substantially the same state. Moreover, such a second energy source can apply the energy at any time and/or location between the heating of the tunable-resistivity material 12 in the nip 11 to before the tunable-resistivity material 12 is programmed with a different pattern by the energy source 16. Prior to being programmed by the energy source 16, the second energy source can erase latent resistive image in the tunable-resistivity material 12.

Although a separate energy source has been described for erasing the tunable-resistivity material 12, the erasing can be performed by the energy source 16. For example, the modulation of the energy beam 18 from the energy source 16 can be appropriately configured to heat the tunable-resistivity material 12, and then control the modulation of the energy source 16 over different portions of the tunable-resistivity material 12 to induce different resistivities.

Figure 2:
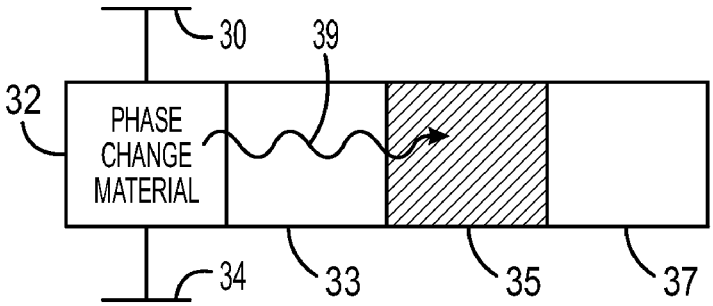
FIG. 2 is a block diagram of an example of a connection to the tunable-resistivity material of FIG. 1.

FIG. 2 is a block diagram of an example of a connection to the tunable-resistivity material of FIG. 1. In this embodiment, phase change material 32 represents a section of the tunable-resistivity material 12. The phase change material 32 is covered by the outer layer 33 similar to the outer layer 13 of FIG. 1. FIG. 2 represents the relationship of structures in the nip 11 of FIG. 1. Thus, marking material 35 contacts the outer layer 33 and the donor structure 37. The donor structure represents a part of the donor structure 22 of FIG. 1.

The phase change material 32 is connected between electrodes 30 and 34. A voltage can be applied between electrodes 30 and 34. Accordingly, an amount of heat 39 will be dissipated in the phase change material 32 according to its resistivity and at least a portion will propagate to the outer layer 33 and the marking material 35.

In an embodiment, the phase change material 32 can be tunable between bi-stable electrical states meaning the phase change material 32 can be capable of being switched back and forth many times without reliability issues. In addition, the phase change material 32 can have fast switching speeds, for example, at about 10 nanoseconds, which can result in a data rate of about 100 Mbits/s. The energy source 16 can be modulated at such speeds to tune the phase change material 32. For example, an optical raster output scanning (ROS) laser diode system can be modulated as such speeds to be used as the energy source 16.

Examples of materials having such tunable-resistivity characteristics are chalcogenide materials used in RW-CDs and RW-DVDs and vanadium dioxide (VO2) used for high speed photochromic switching. For example, the phase change material 32 can include any chalcogenide binary, tertiary, or quaternary semiconductor alloy capable of being switched between high and low electrical resistive states. Binary chalcogenide materials that can exhibit resistive switching memory include materials such as GexTey, GaxTey, InxTey, GexTiy, InxSby, InxSey, SbxTey, GaxSby, GexSby, and SexSby. x and y refer to the proportional amounts of each element. In some materials, x and y combined account for close to 100% of the composition. In other materials, dopants of one or more other elements can be present. Tertiary chalcoginide materials that can exhibit resistive switching memory include InxSbyTez, InxSbySez, InxSbyGez, InxSbyGaz, GexSbyTez, GexSbySez, SexSbyTez, GexSeyTez, InxSbyTez, where x,y, and z operate similarly to x and y above. Quaternary chalcoginide materials that can exhibit resistive switching memory include AgInSbTe, SiGeSbSe, in any compositional amount.

In another example. The phase change material 32 can be any metallic oxide material known to exhibit stable electrical switching states. For example, such phase change metallic oxides can include Nb2O5, Al2O3, Ta2O5, TiO2, NiO, SrTiO3, ZrO2, or any other compositional variation of these alloys.

Some of these materials have shown repeatable bi-stable switching properties with low energy diode lasers over many billions of cycles. It should be noted that one of the most popular chalcogenide materials today is the so called GST material which is very close in chemical formulation to Ge2Sb2Te5 and can be used for this application. Both the GST and VO2 materials can change their resistivity over several orders of magnitude in response to laser heating. For example, the resistivity of some phase change electrical materials in the polycrystalline state can range between about 0.01-1.0 Ohm-cm and a resistivity in the amorphous state is between about 100-1E5 Ohm-cm.

In addition, both resistivity states can exist as relatively thin layers in the range of about 10-100 nm thick and both exhibit hysteretic dramatic changes in electrical properties that can be optically programmed by heating them up and cooling them down according to particular laser modulation methods. Moreover, the relative thinness results in a reduced amount of energy to change their phase allowing for lower power energy sources such as diode lasers, and/or higher throughput when tuning the resistivity.

In an embodiment, the energy source 16 can be controlled to melt the phase change material 32 and allow it to re-solidify into an amorphous state. As a result, a high resistance will be present and a reduced amount of local heating will be induced. For example, a laser can be pulsed at a repetition rate less than about 10 nanoseconds with a high laser power.

The phase change material 32 can be recrystallized into a polycrystalline state to set the resistivity to a lower level. For example, the energy source 16 can apply continuous laser energy at a lower energy state. Phase change materials as described above have been designed so that the recrystallization times, given sufficient power, can be on the order of 10-100 ns.

In an embodiment, when using a bi-stable phase change material 32, the tunable-resistivity material 12 can have a bi-stable resistivity. Pattern-wise changing the phase of the tunable-resistivity material 12 can include pattern-wise changing the phase of the tunable-resisitivity material 12 between a first phase having a first resistivity and a second phase having a second resistivity different from the first resistivity.

In an embodiment, layers of the image receiving structure 10 can be selected to be substantially transparent to the energy beam 18 from the energy source. In addition, the layers can be selected to have refractive index matching properties to reduce reflections. Accordingly, energy transfer to the tunable-resistivity material 12 can be increased. In addition, one or more layers of the image receiving structure 10 can act as a passivation layer that does not allow the tunable-resistivity material 12 to migrate or diffuse into surrounding layers.

In addition, the layers can be selected to be able to handle the thermal diffusion from the tunable-resistivity material 12. For example, a layer can be selected having a lower thermal conductivity. As a result, heat needed to change a phase of the tunable-resistivity material 12 can be reduced as less heat escapes into the surrounding layers. Alternatively, layers can be selected with higher thermal conductivity. Accordingly, when particular programmed regions of the tunable-resistivity material are energized, the resulting heat can be efficiently transferred to the marking material. In an embodiment, a dielectric layer composed of mixture of ZnS(80%)-$SiO_2$ (20%) can satisfy such of requirements for a wide variety of chalcogenide phase change materials.

Figure 3:
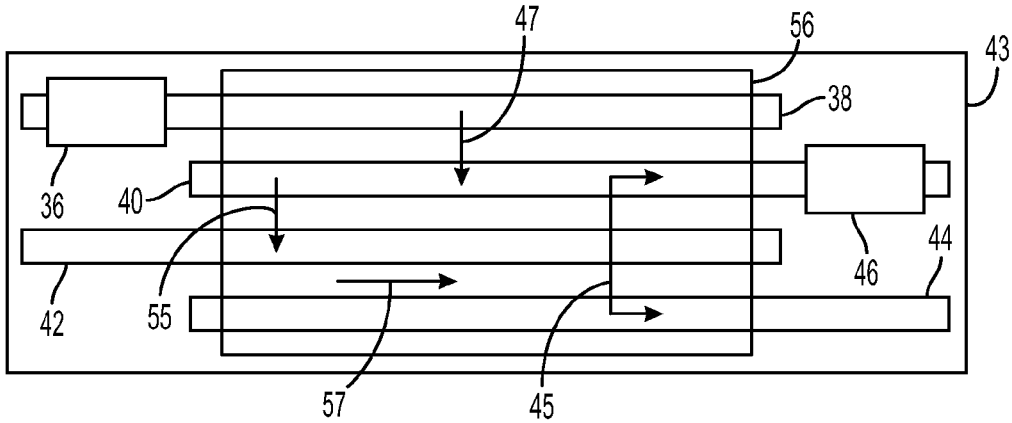
FIG. 3 is a diagram illustrating a layout of electrodes on an image receiving structure according to an embodiment.

FIG. 3 is a diagram illustrating a layout of electrodes on an image receiving structure according to an embodiment. The embodiment includes an image receiving structure 43 including a tunable-resistivity material 56; and multiple electrodes coupled to the tunable-resistivity material. Tunable-resistivity material 56 represents material that is electrically connected to electrodes 38, 40, 42, and 44. Brushes 36 and 46 can be used to contact the electrodes.

In an embodiment, the image receiving structure 43 can be a drum. FIG. 3 can represent a top view of a portion of the cylindrical surface of the drum. The brushes 36 and 46 can be disposed such that as the drum rotates, each of the electrodes of the drum rotates to be in contact with a corresponding one of the brushes 36 or 46. For example, in FIG. 3, brush 46 is illustrated as contacting electrode 40. However, as the drum rotates, electrode 44 can be brought into contact with brush 46.

Although a drum has been given as an example of the image receiving surface 43, any shape can be used. For example, any shape, such as a belt configuration, that allows the brushes 36 and 46 to contact the electrodes 38, 40, 42, 44, and any other electrodes can be used. In addition, although only one electrode has been illustrated as being coupled to a brush at one time, a single brush can contact multiple electrodes. For example, brush 36 can be sized to contact electrodes 36 and 42 simultaneously. As a result, multiple rows of the tunable-resistivity material 56 can be heated at any one time.

In an embodiment, a raster optical scanning system can follow the electrodes such that changes to the resistivity can be induced in the region between these lines. An optical reflective feedback system can be used to center the lasers and provide tracking feedback. In another embodiment, endpoint patterns at the edges of the image receiving structure 10 can also provide feedback.

Figure 4:
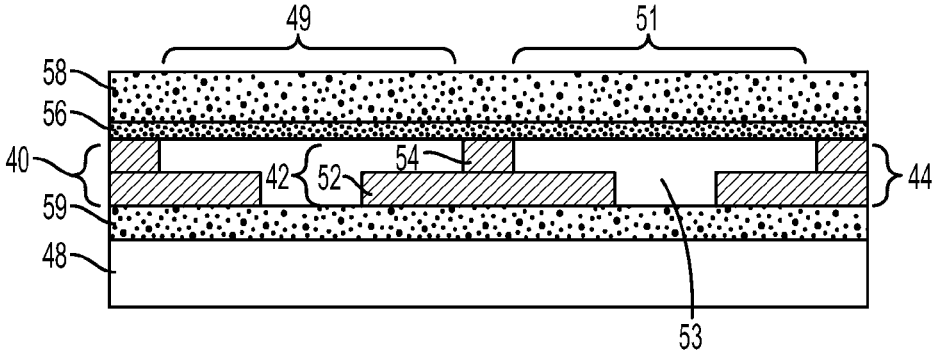
FIG. 4 is a cross-sectional view of the image receiving structure of FIG. 3.

FIG. 4 is a cross-sectional view of an image receiving structure according to an embodiment. The cross-section of FIG. 4 is along line 45 of FIG. 3. Referring to FIGS. 3 and 4, in this embodiment, a dielectric 59 is disposed on a substrate 48. Electrodes 38, 40, 42, and 44 are disposed on the dielectric 59. Heating can be accomplished by passing current between the brushes 36 and 46. Accordingly, current can flow through electrodes 38 and 40, and the tunable-resistivity material 56 between electrodes 38 and 40.

Electrodes 38, 40, 42, and 44 of FIG. 3 or FIG. 4 can be any variety of conductive materials. For example, metallic materials of can include copper, aluminum, or the like, which have relatively low intrinsic resistivity, can be used. Moreover, such metallic materials can act to thermally isolate adjacent pixels of the tunable-resistivity material 56 by redirecting the lateral spread of thermal energy downward towards the substrate 48 which serves as an electrical and thermal ground plane. For example, if the tunable-resistivity material 56 in region 49 is heated, that heat could migrate to region 51. However, since electrode 54 can have a higher thermal conductivity, migrating heat can be directed into the electrode 54 rather than region 51 and any marking material contacting region 51. Accordingly, a stable high resolution thermal image can be formed over a longer time period. Thus the tunable-resistivity material 56 can, but need not be heated line by line. Instead a swath of the imaging surface can be heated at once. Accordingly, an alignment of the heated image to the exit of the nip can have a reduced tolerance. That is, the longer the thermal image maintains its contrast by isolating the dissipation of the heat, the thermal image can be established both before the nip, maintained after the exit of the nip, or the like.

A thermally and electrical insulating layer 53 is disposed between the electrodes. The thermally insulating layer 53 thermally insulated the tunable-resistivity material 56 from portions of the electrodes 38, 40, 42, and 44, and the dielectric 59. Accordingly, a reduced amount of heat from the tunable-resistivity material 56 will be lost to the electrodes 38, 40, 42, and 44, the dielectric 59, the substrate 48, or the like.

The tunable-resistivity material 56 is disposed over the electrodes 38, 40, 42, and 44 and the thermally insulating layer 53. The tunable-resistivity material 56 is electrically connected to the electrodes 38, 40, 42, and 44. In an embodiment, the electrodes 38, 40, 42, and 44 can have portions of varying width. For example, electrode 42 includes a first portion 54 having a first width and a second portion 52 having a second width greater than the first width. The first portion 54 is in direct contact with the tunable-resistivity material 56. The current that passes through the tunable-resistivity material 56 from electrode 42 can enter at the connection between the brush 36 and electrode 42. The larger second portion 52 can provide a low resistivity path along the length of the electrode 38. The first portion 54 provides a connection from the low resistivity second portion 52 to the tunable-resistivity material 56. Since the second portion 54 would carry substantially only the current to the adjacent region of the tunable-resistivity material 56, a lower current density passes through the second portion 54. As a result, the second portion 54 can be made smaller, yet still have a reduced effect on the voltage drop between the brushes 36 and 46. Accordingly, current can be efficiently directed to the tunable-resistivity material 56, and the tunable-resistivity material 56 can be thermally insulated from a majority of the electrodes.

In an embodiment, such a horizontal arrangement of the tunable-resistivity material 56 can tolerate defects in the material. For example, during manufacturing, pinhole defects can be formed in the tunable-resistivity material 56. Even if such pin holes are present, the pinholes would be perpendicular to the flow of current. Accordingly, the pin holes have a reduced effect on the resistivity of the tunable-resistivity material 56.

In an embodiment, pixelation of an image can occur due to the electrodes. For example, since a first current can flow from electrode 38 to electrode 40 along axis 47, heating the tunable-resistivity material 56 through which the current passes. The next different current that can flow is between electrode 40 and 42 along axis 55. Thus, the resolution in the direction of axis 47 is limited by the electrode spacing. In contrast, in axis 57, the resistivity of the tunable-resistivity material 56 can be varied without regard to the electrode spacing. For example, by directly modulating the laser at a high bandwidth, a high resolution control can be achieved along axis 57. As a result, a higher effective pixel density along axis 57 can be achieved. This can allow a higher resolution, a variable spot width gray scale, or the like to be achieved.

Figure 5:
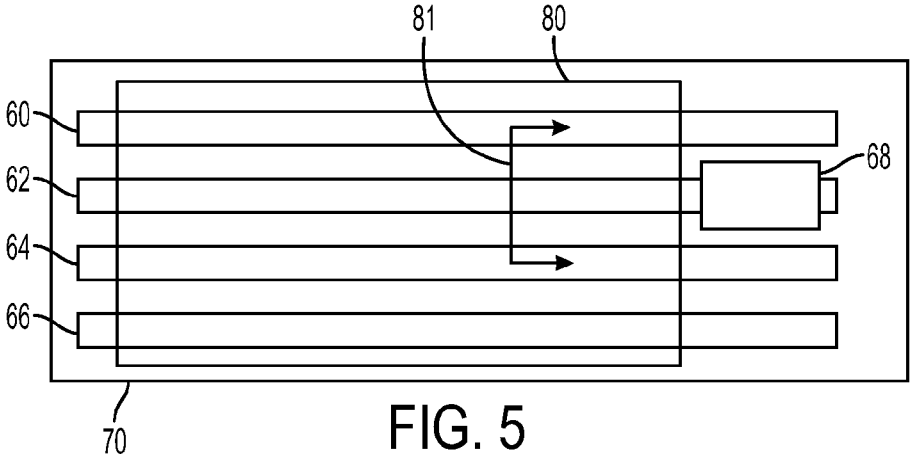
FIG. 5 is a diagram illustrating a layout of electrodes on an image receiving structure according to another embodiment.

FIG. 5 is a diagram illustrating a layout of electrodes on an image receiving structure according to another embodiment. In this embodiment, the image receiving structure includes a conductive substrate 70 on which electrodes 60, 62, 64, and 66, and the tunable-resistivity material 80 are formed. A brush 68 can contact the electrodes 60, 62, 64, and 66. The electrodes 60, 62, 64, and 66 can be used as an electrical connection to one side of the tunable-resistivity material 80. The other connection is the conductive substrate 70. That is, current used to heat the tunable-resistivity material 80 flows between the brush 68 and the conductive substrate 70.

Figure 6:
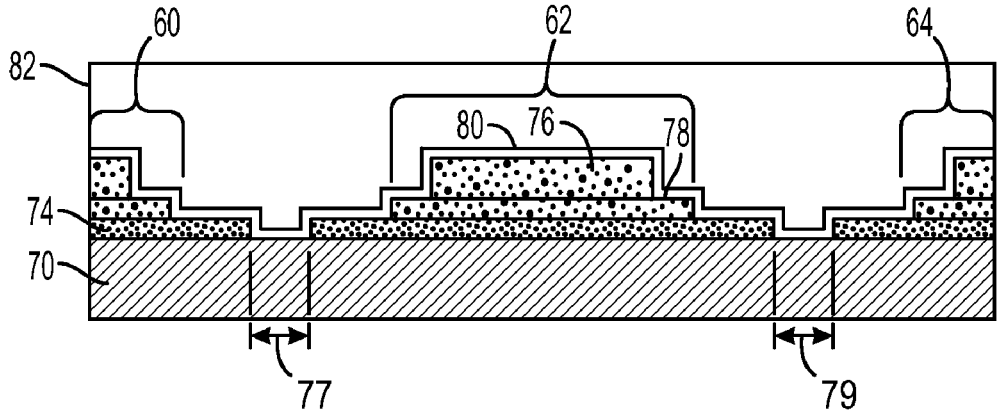
FIG. 6 is a cross-sectional view of an example of the image receiving structure of FIG. 5.

FIG. 6 is a cross-sectional view of an example of the image receiving structure of FIG. 5. The electrodes 60, 62, and 64 are disposed over an insulating material 74. The insulating material 74 is disposed over the conductive substrate 70. In this embodiment, the electrodes 60, 62, and 64 include two regions 76 and 78. Region 76 is narrower in width than region 78; however, it is thicker than region 78. Accordingly, current can flow through region 76 with less of a voltage drop than through region 78. Current can be distributed along the length of the electrode 62 with a reduced voltage drop. The thinner region 78 can be use to locally distribute current to the tunable-resistivity material 80. That is, it may not carry as much current as region 76 and can be thinner without an excessive voltage drop or associated heating.

Openings 77 and 79 expose the conductive substrate 70. The tunable-resistivity material 80 can contact the conductive substrate 70 through the openings 77 and 79. Accordingly, current can flow between the electrodes 60, 62, and 64, and the conductive substrate 70 through the tunable-resistivity material 80 and the corresponding openings 77 and 79. An outer layer 82, such as silicone, as described above, covers the electrodes 60, 62, and 64 and tunable-resistivity material 80.

In an embodiment, the conductive substrate 70 need not be the entire substrate for the image receiving structure. For example, the conductive substrate 70 can be a conductive layer over a non-conductive substrate for the image receiving structure.

Figure 7:
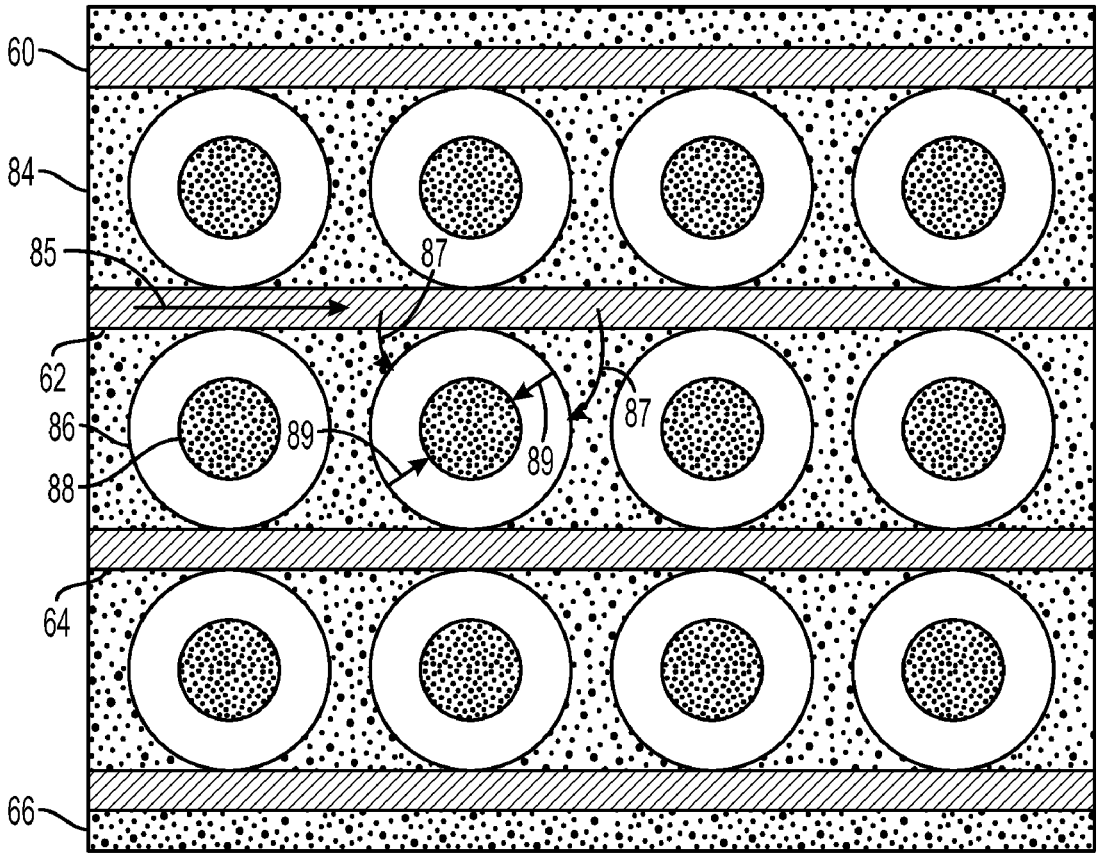
FIG. 7 is a plan view illustrating examples of tunable-resistivity cells on the image receiving structure of FIG. 6.

FIG. 7 is a plan view illustrating examples of tunable-resistivity cells on the image receiving structure of FIG. 6. In this embodiment, the outer layer 82 is not illustrated as it can be transparent. In addition, the tunable-resistivity material 80 is not illustrated as it can be formed over the entire illustrated surface; however, this does not mean that the tunable-resistivity material 80 must be formed over the entire surface. For example, the tunable-resistivity material 80 can be formed on the electrodes only over the thinner regions 78.

Referring to FIGS. 6 and 7, in this embodiment, each tunable-resistivity cell has an opening 88. Similar to the openings 77 and 79, the opening 88 allows electrical contact to the conductive substrate. Opening 86 is an opening in the electrodes exposing the insulating material 74. In particular, it is an opening in the thinner regions 78 of the electrodes.

The openings 86 and 88 form concentric circles. Accordingly, a distance from region 78 of the electrodes to the conductive substrate 70 can be substantially similar. As a result, assuming that the tunable-resistivity material 80 for the cell is programmed with the same resistivity, the resistance of the cell can be substantially evenly distributed over the cell.

Currents 85, 87, and 89 represent some currents that can flow through a tunable-resistivity cell. Current 85 is the current passing through region 76 of the electrode 62. Currents 87 represent the current passing through region 78 to the tunable-resistivity material 80 of the cell. The resistivity of region 78 can be selected to be substantially less than the resistivity of the lowest resistivity state of the tunable-resistivity material 80. Thus, even if a current 87 would travel a longer path from electrode 62 towards electrode 64, the additional resistance due to the longer path can still be lower than the lowest resistivity of the tunable-resistivity material 80. Currents 89 represent the current distribution through the tunable-resistivity material 80. Because of the lower resistivity of the regions 76 and 78 of the electrodes, the current can be substantially evenly distributed over the tunable-resistivity material 80 of the cell. As a result, heat generated by the cell can be substantially evenly distributed.

The resistivity of region 78 of the electrodes can be selected to localize the current distribution from an electrode. For example, since electrodes 60, 64, and 66 are electrically connected to electrode 62, portions of current 85 can flow to those electrodes even if they are not directly energized. However, as region 78 of the electrodes separate regions 76, any current passing to other electrodes must pass through one or more regions 78 of the electrodes. As region 78 is thinner, it can have a higher resistivity than region 76. Thus, for each subsequent section of region 78, the total resistance increases, reducing the amount of current that flows through that section. Accordingly, the resistivity of region 78 can be selected to both below an amount to substantially evenly distribute current in a given row of tunable-resistivity cells yet high enough isolate a number of other rows of tunable-resistivity cells from the applied current. As a result, the rows of tunable-resistivity cells that are energized can be controlled.

Although the region 78 has been described as being electrically connected between electrodes, the all electrodes need not be electrically connected. For example, gaps in region 78 can separate one or more electrodes from other electrodes. Although a circle has been used as an example, the openings 86 and 88 can have different shapes. Any shapes such that the resistance of the cell is substantially evenly distributed can be used. For example, a substantially square shape can be used with the corners formed to substantially evenly distribute the resistance of the cell.

Although the tunable-resistivity cells have been illustrated in a recto-linear arrangement, the tunable-resistivity cells can be disposed on the image receiving structure as desired. For example, the tunable-resistivity cells could be disposed in a hexagonal arrangement. Accordingly, the electrodes may not be straight as illustrated and could weave in between the tunable-resistivity cells.

In an embodiment, the size of a tunable-resistivity cell can be made smaller than a spot size of the energy beam 18 used to program the tunable-resistivity material. For example, opening 88 could be about 3 ums in diameter, the opening 86 could be about 9 ums in diameter, and the cell spacing could be about 12 ums center to center. This can result in approximately 2400 dpi in density in tunable-resistivity cells.

With such a cell density and a larger laser spot size, the alignment of the energy beam 18 to the image receiving structure can, but need not be as precisely controlled. For example, a laser spot size is about 42 ums or larger, a misalignment of the tunable-resistivity cell pattern to the sweep of the laser has a reduced impact on image quality. That is, in this example, the laser spot size is about 3.5 tunable-resistivity cells in width. Accordingly, a misalignment of a tunable-resistivity cell will have a reduced impact.

Although embodiments described above have had the electrodes substantially aligned in one dimension, the electrodes can be aligned in multiple dimensions. For example, electrodes can be aligned in two dimensions across the surface of the image receiving surface.

In addition, if the laser strays to close to the electrical connection between the phase change layer and an address line, the thermal time constant may be impacted due to the high thermal conductivity of the electrical address lines. Accordingly, the energy source 16 can includes a feedback controller configured to align the energy beam 18 to the tunable-resistivity material between the electrodes. As a result, the impact of the higher thermal conductivity can be reduced.

In an embodiment, current can be passed in a direction that is vertical with respect to the image receiving structure 10. For example, the image receiving structure can include a first electrode, a second electrode over the first electrode, and the tunable-resistivity material disposed between the first electrode and the second electrode. With a vertically directed geometry, a need for patterning of the image receiving structure, tracking of the energy beam 18 to the image receiving structure, or other image receiving structure pattern related requirements can be reduced or eliminated.

In such a vertical directed geometry, a pin-hole free coating schemes can be used. Atomic layer deposition (ALD) processes can be pin hole free for a few nm layer thickness. This layer can be conformal to a non-uniform surface. In addition various oxides can be put down with ALD. For example, $Al_2O_3$ can be deposited using ALD to conformally coat a surface free of pin holes.

Moreover, the relative distance through the tunable-resistivity material that current passes to generate heat can be thinner than in a horizontal tunable-resistivity material application. Accordingly, the resistivity of the tunable-resistivity material can be selected to be higher. For example, by adjusting the composition of metal oxide materials, switching states having higher resistivities than chalcogenide materials can be created. Such oxides include Nb2O5, Al2O3, Ta2O5, TiO2, NiO, SrTiO3, and ZrO2.

In addition, the first electrode and/or the second electrode can be made transparent to the energy of the energy beam 18. As a result, such electrodes can be between the energy source 16 and the tunable-resistivity material, yet the tunable-resistivity material can still be programmed. In another embodiment, thin conductive layers in a mesh can be used for the electrodes. For example, a thin metal mesh layer can have a higher conductivity that some optically transparent materials. However, the mesh structure can allow an amount of transparency and an amount of flexibility.

Figure 8:
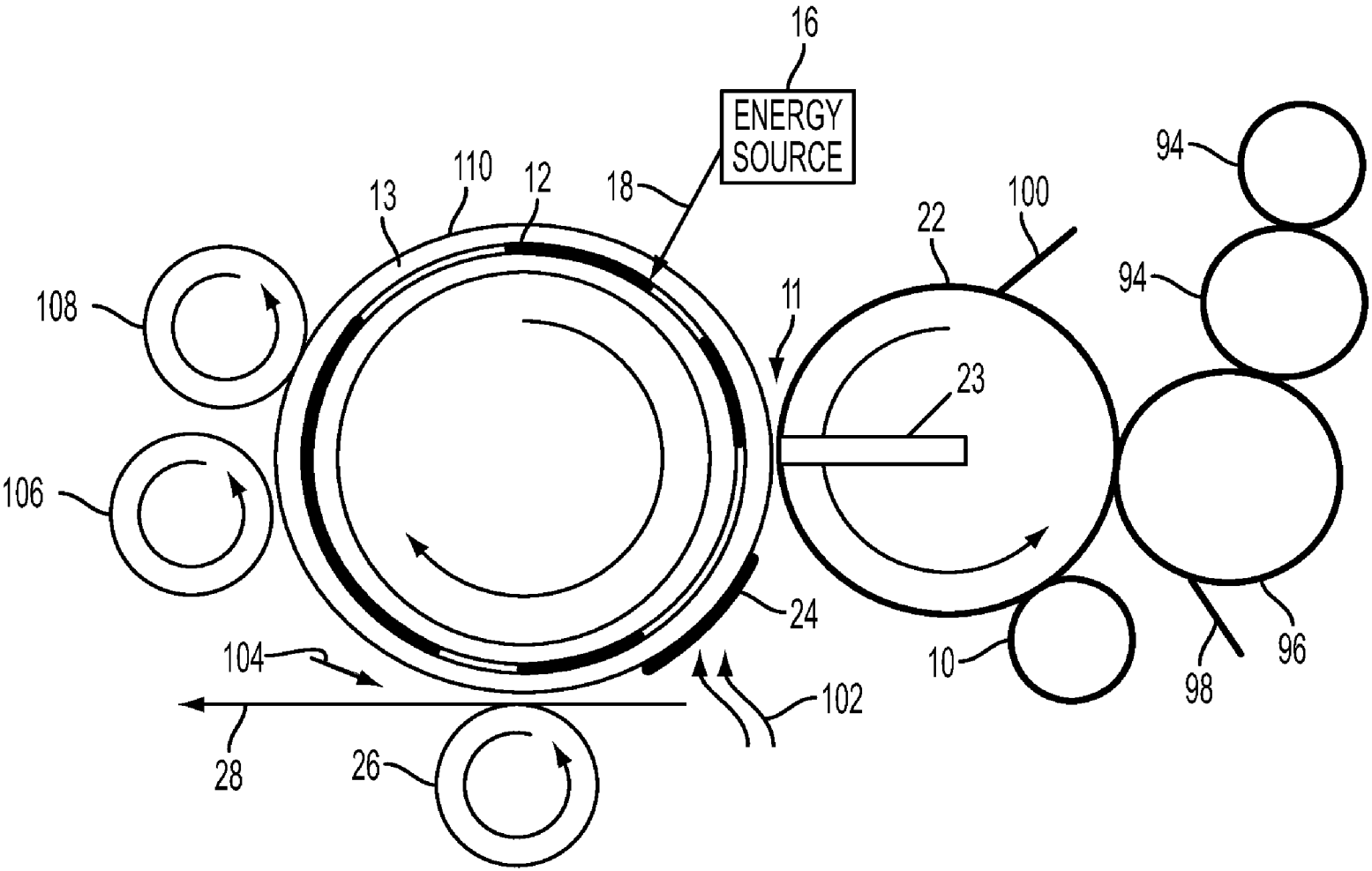
FIG. 8 is a diagram illustrating an imaging system having a tunable-resistivity material according to another embodiment.

FIG. 8 is a diagram illustrating an imaging system having a tunable-resistivity material according to another embodiment. This embodiment illustrates additional systems that can be part of the imaging system. Forming rollers 94 can be used to apply marking material to an anilox roller 96. A doctor blade 98 can shape the marking material on the anilox roller 96.

Accordingly, marking material can be metered onto the donor surface 22. In an embodiment, the marking material can be metered using a 'keyless' marking material metering system. Such a marking material metering system does not require adjustment of the marking material flow based upon the image coverage area and can be used with waterless marking materials. The doctor blades 98 and 100 can be used to control the thickness and uniformity of the marking material. Once a substantially uniform marking material layer has been formed on the donor surface 22, the marking material can be rotated into the nip 11 were it can be heated as described above by energizing the tunable-resistivity material 12.

A cooling source can cool the patterned marking material 24. For example, cool air 102 can be directed towards the patterned marking material 24. As a result, the patterned marking material 24 that was heated to adhere to the image receiving structure 110 can be cooled to reduce the adhesion to the image receiving structure 110. Since the patterned marking material 24 is not in contact with a surface other than the image receiving structure 110, even with the lowered adhesion, it will still adhere to the image receiving structure 110. However, when brought in contact with the substrate 28, the patterned marking material 24 can adhere to the substrate 28. As described above, the marking material can be removed from a silicone surface with about 100% efficiency. As a result, a substantial amount of the patterned marking material 24 is transferred to the substrate 28.

In an embodiment, an air knife 104 can be used to separate the substrate 28 from the image receiving structure 110. Although the adhesion of the patterned marking material 24 to the substrate 28 may be greater than the adhesion to the image receiving structure 110, the adhesion of the marking material to the image receiving structure 110 can cause the substrate 28 to adhere to the image receiving structure 110. In particular, if the substrate 28 is a single page of paper, for example, the leading edge of the paper may follow the image receiving structure 110 up towards the cleaning roller 106. Accordingly, the air knife 104 can separate the substrate from the image receiving structure 110. Alternatively, or in addition, the substrate 28 can be held under tension to separate it from the image receiving structure 110.

Although about 100% of the patterned marking material 24 can transfer to the substrate, some portion can remain. If left on the image receiving structure 110, the remaining marking material can cause ghosting in subsequent imaging operations. Accordingly, a cleaning roller 106 and a conditioning roller 108, or the like can be used to prepare the image receiving structure 110 for subsequent applications of marking material.

Although forming rollers, doctor blades, anilox rollers, conditioning rollers, cleaning rollers, and the like have been described above, such systems need not be identical to those illustrated in FIG. 8. In an embodiment, any system that can form a substantially uniform layer of marking material by the time the marking material is in the nip 11 can be used. Similarly, any conditioning system that removes marking material from the image receiving structure 110 can be used.

In an embodiment, the imaging receiving structure 110 can be a drum. The drum can be a cylindrical glass drum. The deposition of the tunable-resistivity material 12 on the cylindrical glass drum can be performed with drum sputtering systems designed for large area batch sputtering of flexible substrates. Alternatively, the tunable-resistivity material 12 can be sputtered on a flexible high temperature compatible dielectric substrate such as polyimide. Localized annealing at temperatures at about 440 C can be used to transform the sputtered amorphous $VO_2$ to a crystalline form that exhibits the change in energy transfer characteristics.

Figure 9:
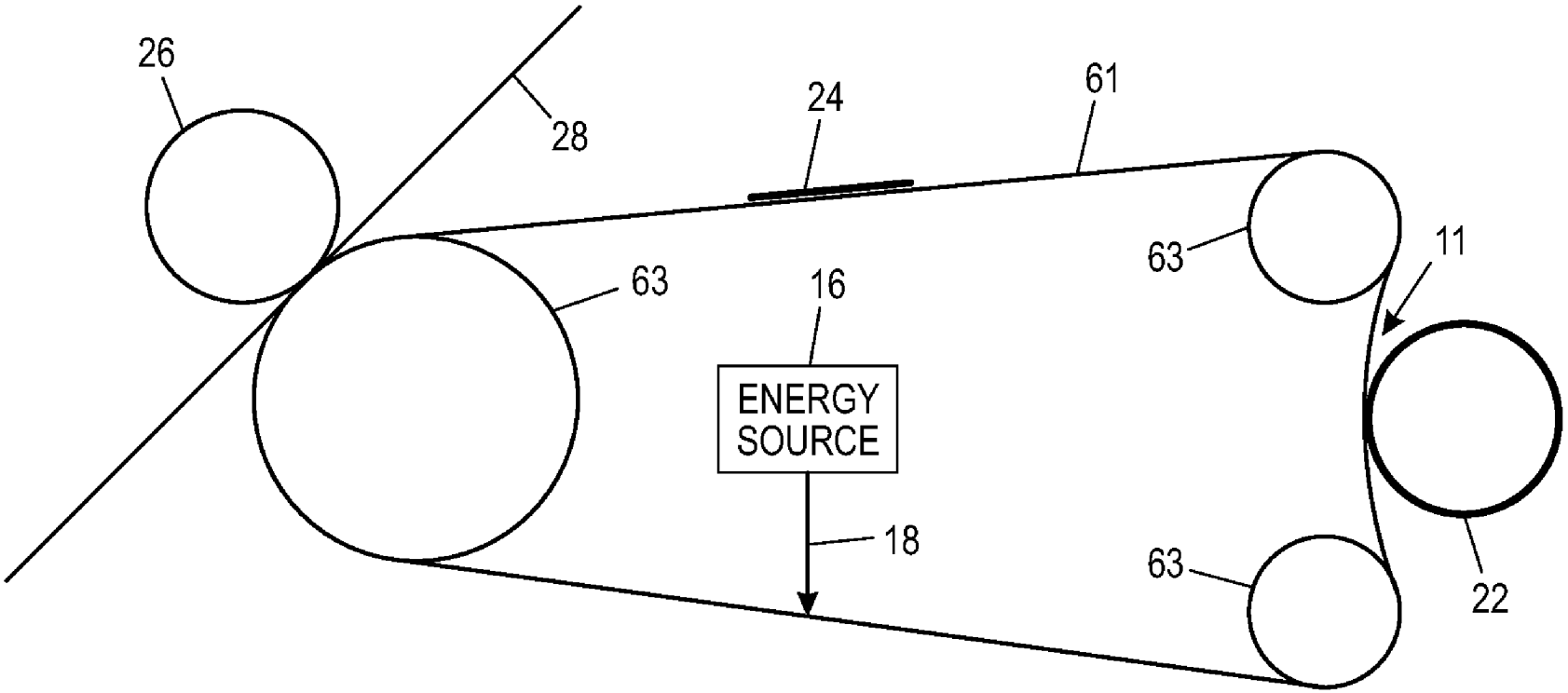
FIG. 9 is a diagram illustrating an imaging system having a tunable energy transfer characteristic according to another embodiment.

FIG. 9 is a diagram illustrating an imaging system having a tunable energy transfer characteristic according to another embodiment. Although a drum or a cylinder has been described above as a supporting substrate for the image receiving structure 10, other supporting substrates can be used. In this embodiment, the supporting substrate is a belt 61. Rollers 63 can tension the belt 61. As a result, contact with the marking material of the donor roller 22 is maintained in the nip 11. Patterned marking material can be transferred to the belt 61 similar to the transfer to the image receiving structure 10 as described above as illustrated by patterned marking material 24. The patterned marking material 24 can then be transferred to the substrate 28 by impression roller 26.

The belt 61 can have a cross-section similar to that described with reference to FIG. 2. However, in this embodiment, the supporting substrate 36 of FIG. 2 would be material of the belt 61. In an embodiment, a material of the belt 61 has high strength, high tear and scratch resistance, low cost, and is optically transparent over the wavelength range of the energy sources used for heating and/or patterning. For example, optically clear polyethylene terephthalate can be used as a belt material as it is transparent over a wavelength range from about 600 nm-1100 nm.

The deposition of the mask layer of the belt 61 can be performed similar to techniques described above. For example, a nanoparticle liquid suspension of $VO_2$ can be dip coated over the belt. Similar techniques can be used to apply the outer layer as described above.

Due to the belt geometry, the space limitations of fitting a laser raster scanning system, line image projection optics, or the like within a drum 9 as described above can be alleviated. Routing of the belt 61 can allow more internal access to the nip region. As a result, first and second energy sources 16 and 14 can be disposed within the belt 61.

Figure 10:
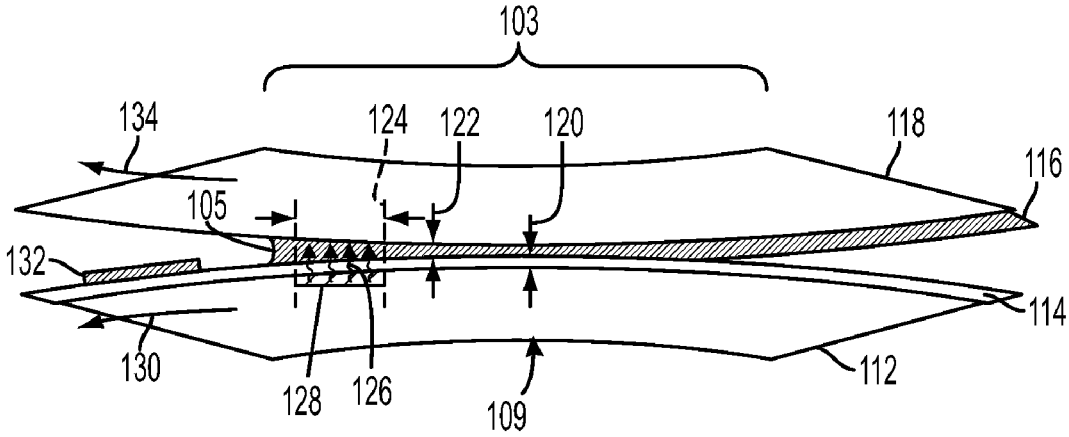
FIG. 10 is a cross-sectional view of a nip according to an embodiment.

FIG. 10 is a cross-sectional view of a nip according to an embodiment. In an embodiment, the energy can be deposited in the nip region between the donor 118 and image receiving structures 112 such that the heat does not have time to diffuse. If the heat does have time to diffuse, the desired image can be washed out. Distance 120 is the thickness of the outer layer 114 of the image receiving structure 112. Distance 122 is the thickness of the marking material 116 in the nip. The thickness 122 is a minimum where the donor structure 118 and image receiving structure 112 are at their closest at location 109. Arrow 130 indicates a direction of rotation of the image receiving structure 112. Arrow 134 indicates a direction of rotation of the donor structure 118. Region 124, where the heat 126 is transferred from the tunable-resistivity material 128 to the marking material 116, is offset from location 109. That is, the heat transfer occurs as a location 124 offset from the location 109 where the image receiving structure 112 and the donor structure 118 are the closest.

Figure 11:
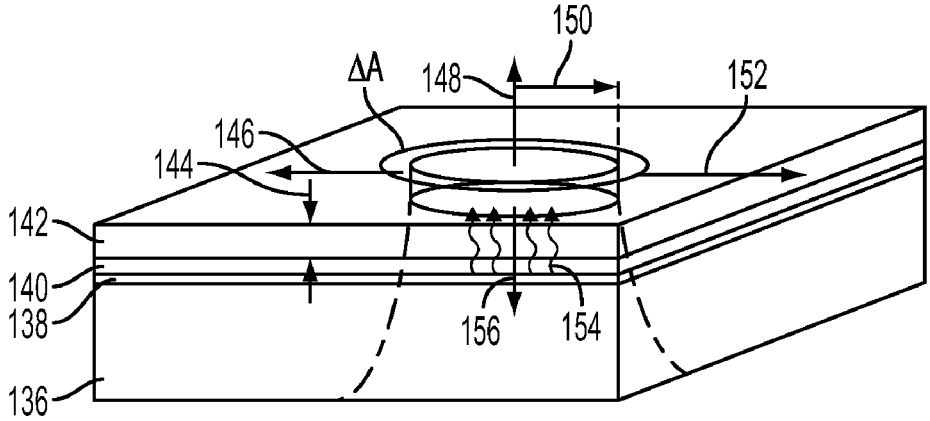
FIG. 11 is an isometric view of heat dissipation in the marking material in FIG. 10.

FIG. 11 is an isometric view of heat dissipation in the marking material in FIG. 10. In this view, a tunable-resistivity material 138 is illustrated between the substrate 136 and the outer layer 140. This view illustrates the conduction of heat 154 from the point of application of energy to the tunable-resistivity material 138.

Referring to both FIGS. 10 and 11, in an embodiment, for imaging to occur, the marking material should transfer to the outer layer 140 at the exit 105 point of the nip 103 in a time period less than the lateral thermal diffusion time constant or image blurring can occur. Accordingly, the heat spreading area $\Delta A$ can be a fraction of the heated area with radius 150. In addition, the overall diffusion rate of heat in both the vertically and lateral directions should not be so fast so as to allow the marking material to cool down before it has a chance to split at the exit 105 of the nip 103. Marking material 132 represents marking material that was heated to transfer it to the image receiving structure 112.

As the location 124 is moved further away from the exit 105 of the nip 103, heat will have a longer time to diffuse and the temperature of the marking material 116 will have a longer time to decrease from its peak value. Thus, in an embodiment, the location 124 where the tunable-resistivity material 128 is heated can be disposed close to the exit 105 of the nip 103. However, if the location 124 is too close to the nip exit 105 such that the marking material 116 has already partially lifted off the outer layer 140, then a non-uniform transfer can occur.

In addition, the marking material 116 can be thinner than the width of the heated location 124. As a result, splitting dynamics of the marking material for one pixel can be isolated from the dynamics of neighboring pixels. Typical waterless offset inks can be put down on paper in a thickness range of about 0.5 to 1.0 micron. Accordingly, at a resolution of even 1200 dpi (21 ums spacing), there is still about a 1:20 ratio between the marking material 116 thickness and the nearest neighbor pixel.

A time constant for thermal diffusion can be estimated from marking material parameters. At an imaging resolution of 600 dpi, a heated pixel region can be on the order of 42 ums in diameter. As described above the marking material thickness 142 is no more than about a few microns thick. Because the marking material thickness 142 is much less than the width 150 of the conducted heat, vertical diffusion of heat dominates the overall cooling time constant. That is, heat diffusion can occur in directions 146 and 152; however, more heat will be transferred in directions 148 towards the donor structure 116 or in direction 156 towards the image receiving structure 112.

The thermal conductivity of the outer layer 140 depends on the formulation. If a native PDMS material is used without modified chemistry, the thermal conductivity, KPDMS, is expected to be close to the range of 0.15-0.2 W/m-K. While the exact specific heat and thermal conductivity of the marking material 142 vary from one formulation to another, typical values for waterless offset inks can be used to give order of magnitude calculations. Typical thermal values for the high molecular weight oils used in waterless inks are a specific heat $c_\rho$~2000 J/kg-K, a mass density of $\rho_{ink}$~1.0 gm/cc, and a thermal conductivity $\kappa_{ink}$~0.15 W/m-K. Given that vertical conduction dominates the loss of heat, the expected thermal time constant can be estimated from a scaling relation in equation 1:

$$t_d = c_\rho * \rho_{ink} * d^2 / \kappa_{PDMS} \quad (1)$$

d is on the order of the absorption depth thickness of the marking material in the nip. For the typical values stated, the diffusion time, $t_d$ is on the order of 100 us assuming d=2-3 um as the overall absorption depth. In contrast, the time constant for lateral heat diffusion through the ink is expected to be on the order of 1 ms due to the fact the heat has to travel through 42 ums. For print speeds of 100 ppm, the linear feed rate of the printer is on the order of ~0.5 m/s. This speed results in the heated region 124 being positioned to within approximately 50 microns of the exit 105 of the nip 103. As the imaging speed is increased, this requirement can be relaxed somewhat due to the larger distance over which the structures travel within a given thermal time constant.

In an embodiment, the donor structure 118 has a thermal conductivity less than a thermal conductivity of the marking material 116. For example, the donor structure 118 can be made out of a low thermal conductivity material that is compatible with most UV inks. An Ethylene Propylene Diene Monomer (EPDM) coated roller is can be used with UV curable inks and with a thermal conductivity in the neighborhood of about 0.3 W/m-K.

Figure 12:
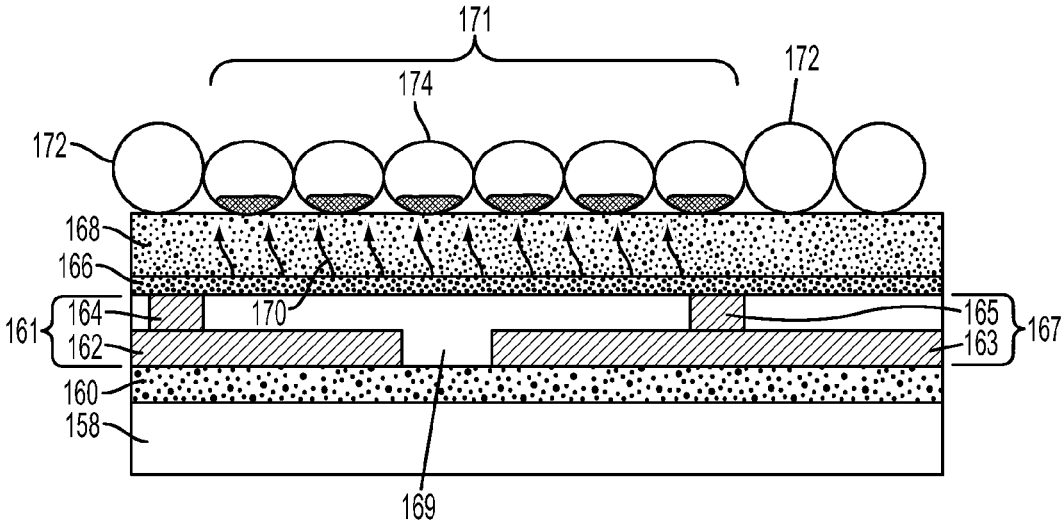
FIG. 12 is a cross-sectional view illustrating an example of pattern-wise heating of marking material according to an embodiment.

FIG. 12 is a cross-sectional view illustrating an example of pattern-wise heating of marking material according to an embodiment. The image receiving structure of FIG. 12 is similar to that of FIG. 4. In particular, the image receiving structure includes a substrate 158, a dielectric 160, a first electrode 161 formed of a first portion 164 and a second portion 162, a second electrode 167 formed of a first portion 165 and a second portion 163, a dielectric 169, a tunable-resistivity material 166, and an outer layer 168.

In this embodiment, the tunable-resistivity material 166 has been tuned to a relatively lower resistivity in region 171 between electrodes 161 and 167. Accordingly, a higher amount of power is dissipated in region 171. Thermal energy 170 passes through the outer layer 168. Accordingly, toner particles 174 are tacked to the outer layer 168 while toner particles 172 outside of region 171 are not. As a result, toner particles are pattern-wise tacked to the image receiving structure, and can be transferred to another substrate.

Figure 13:
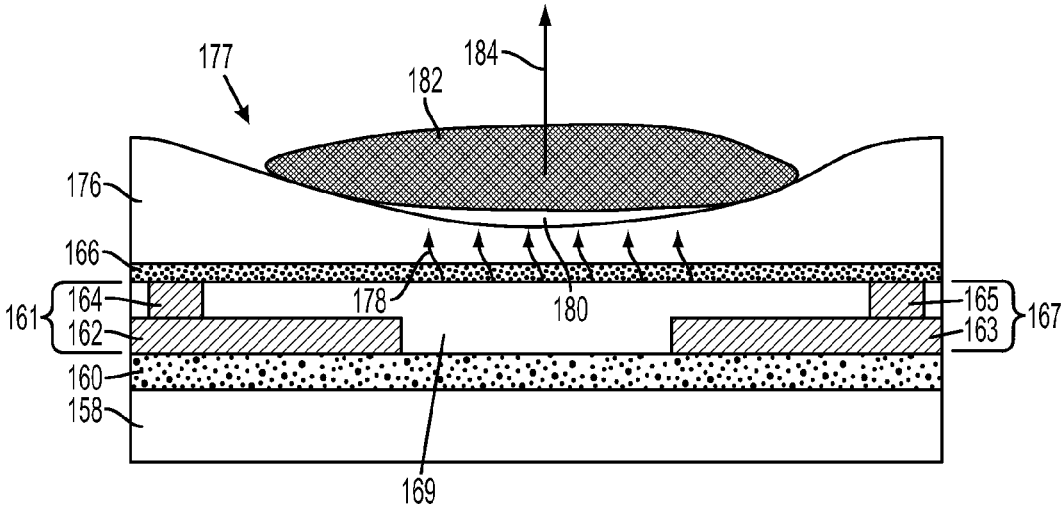
FIG. 13 is a cross-sectional view illustrating an example of pattern-wise heating of marking material according to another embodiment.

FIG. 13 is a cross-sectional view illustrating an example of pattern-wise heating of marking material according to another embodiment. The image receiving structure of FIG. 13 is similar to that of FIG. 12. However, the outer layer 176 includes a depression 177. In this embodiment, the tunable-resistivity material 166 that is between the electrodes 161 and 167 is disposed under the depression 177.

Marking material 182 can be deposited in the depression 177. When thermal energy 178 is transferred to the marking material 182, the marking material 182 can vaporize in a region 180 adjacent to the outer layer 176. The pressure of the expanding vapor in region 180 can eject the marking material 182 in direction 184. A substrate (not illustrated) can be suitably positioned to receive the ejected marking material. Since the tunable-resistivity material 166 can be pattern-wise tuned, the marking material can be pattern-wise ejected on to the substrate.

In an embodiment, the depression 177 can be a circular depression in the outer layer 176. The outer layer 176 can have an array of such circular depressions 177 where each circular depression 177 is associated with an individually addressable portion of the tunable-resistivity material 166. Accordingly, from each depression 177, an amount of marking material can be pattern-wise ejected on to a receiving substrate.

Although a depression 177 and, in particular, a circular depression 177 in the outer layer 176 has been described, any shape or structure that can divide the marking material 182 can be used. For example, different shapes such as square or rectangular depressions, trenches, or the like can be used.

Another embodiment includes an article of machine readable code embodied on a machine readable medium that when executed, causes the machine to perform any of the above described operations. As used here, a machine is any device that can execute code. Microprocessors, tunable logic devices, multiprocessor systems, digital signal processors, personal computers, or the like are all examples of such a machine.

Although particular embodiments have been described, it will be appreciated that the principles of the invention are not limited to those embodiments. Variations and modifications may be made without departing from the principles of the invention as set forth in the following claims.

What is claimed is:

1. An imaging system, comprising:

an image receiving structure comprising:

a conductive substrate;

an insulating material disposed over the conductive substrate;

a plurality of tunable-resistivity cells, each tunable-resistivity cell including an opening in the insulating material; and a conductive layer having an edge offset from an edge of the opening, wherein the edge of the conductive layer is substantially equidistant from the edge of the opening and the tunable-resistivity material is disposed between the edge of the conductive layer and the edge of the opening; and an energy source to emit an energy beam at the image receiving structure to pattern-wise program the tunable-resistivity material.

2. An imaging system, comprising:

an image receiving structure including a tunable-resistivity material;

a plurality of electrodes coupled to the tunable-resistivity material; and an energy source to pattern-wise program the tunable-resistivity material in a region of the image receiving structure prior to contacting the region of the image receiving structure with marking material.

3. The imaging system of claim 2, wherein:

the image receiving structure comprises a plurality of electrodes; and the tunable-resistivity material is electrically connected to the electrodes.

4. The imaging system of claim 3, wherein:

the image receiving structure further comprises a substrate;

the electrodes are disposed over the substrate;

a thermally insulating layer is disposed between the electrodes; and the tunable-resistivity material is disposed over the electrodes and the thermally insulating layer.

5. The imaging system of claim 4, wherein at least one electrode comprises:

a first portion having a first width; and a second portion having a second width greater than the first width;

wherein the first portion is in direct contact with the tunable-resistivity material.

6. The imaging system of claim 3, further comprising:

a first electrode of the plurality of electrodes;

a second electrode of the plurality of electrodes; and an outer layer disposed over the first and second electrodes;

wherein the tunable-resistivity material is disposed between the first electrode and second electrodes, and disposed under a depression in the outer layer.

7. The imaging system of claim 2, further comprising a power supply configured to supply current only to less than all of the tunable-resistivity material at any one time.

8. The imaging system of claim 2, wherein the image receiving structure comprises:

a first electrode; and a second electrode over the first electrode;

wherein the tunable-resistivity material is disposed between the first electrode and the second electrode.

9. The imaging system of claim 2, further comprising:

a second energy source to set resistivity across a portion of the tunable-resistivity material to be substantially uniform.

10. The imaging system of claim 2, wherein the image receiving structure comprises:

a conductive substrate;

an insulating material disposed over the conductive substrate; and the electrodes disposed over the insulating material;

wherein the tunable-resistivity material is electrically connected to both the conductive substrate and the electrode.

11. The imaging system of claim 2, wherein the tunable-resistivity material has a bi-stable resistivity.

12. A method of transferring marking material, comprising:

pattern-wise changing an electrical resistivity of a region of a tunable-resistivity material on an image receiving structure having a plurality of electrodes coupled to the tunable-resistivity material; and pattern-wise adhering marking material to the region of the image receiving structure in response to the electrical resistivity of the tunable-resistivity material after the pattern-wise changing.

13. The method of claim 12, wherein pattern-wise changing the electrical resistivity of the first material comprises:

irradiating the first material with a pattern-wise modulated energy beam.

14. The method of claim 12, wherein pattern-wise changing the electrical resistivity of the first material comprises:

pattern-wise changing a phase of the first material.

15. The method of claim 14, wherein pattern-wise changing the phase of the first material comprises pattern-wise changing the phase of the first material between a first phase having a first resistivity and a second phase having a second resistivity different from the first resistivity.

16. The method of claim 12, wherein pattern-wise adhering the marking material in response to the electrical resistivity of the first material comprises:

pattern-wise heating the marking material depending on the electrical resistivity of the first material.

17. The method of claim 16, further comprising:

applying current to the first material to pattern-wise heat the first material;

pattern-wise heating an image receiving structure with the heat from the first material;

contacting the image receiving structure with the marking material from a donor structure; and pattern-wise separating the marking material from the donor structure.

18. The method of claim 16, wherein pattern-wise adhering the marking material in response to the electrical resistivity of the first material comprises:

applying a voltage between a first electrode and a second electrode;

wherein the first material is electrically connected to the first electrode and the second electrode.

19. The imaging system of claim 2, further comprising:

a donor structure to place marking material in contact with the image receiving structure; and a brush to contact one of the electrodes when the tunable-resistivity material coupled to that electrode is adjacent the marking material in contact with the image receiving structure.

* * * * *